US007140609B2

(12) United States Patent
Bingham et al.

(10) Patent No.: US 7,140,609 B2
(45) Date of Patent: Nov. 28, 2006

(54) LOCKING/UNLOCKING MECHANISM

(75) Inventors: Jeffrey Bingham, Vancouver, WA (US); Craig D. Sunada, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 142 days.

(21) Appl. No.: 10/918,410

(22) Filed: Aug. 16, 2004

(65) Prior Publication Data

US 2006/0071403 A1 Apr. 6, 2006

(51) Int. Cl.
*B65H 1/00* (2006.01)

(52) U.S. Cl. ..... 271/145; 271/162

(58) Field of Classification Search ..... 221/197, 221/287; 271/145, 162, 164; 403/321–326, 403/329, DIG. 14, 397; 347/104; 312/348.4, 312/293.1; 70/450
See application file for complete search history.

(56) References Cited

U.S. PATENT DOCUMENTS 3,059,206 A * 10/1962 Williams ..... 439/157
4,128,354 A * 12/1978 Amrogowicz ..... 403/186
4,406,448 A * 9/1983 Kulpa et al. ..... 271/160
4,904,100 A * 2/1990 Enix ..... 400/613
5,040,915 A * 8/1991 Stuart et al. ..... 403/322.3
5,163,774 A * 11/1992 Lautenschlager ..... 403/245
5,222,791 A * 6/1993 Held et al. ..... 312/348.4
5,276,469 A 1/1994 Beaufort et al.
5,322,383 A * 6/1994 Saito et al. ..... 403/321
5,417,513 A * 5/1995 Hayashi ..... 403/321
5,482,394 A * 1/1996 Shinchi et al. ..... 403/325
5,580,182 A * 12/1996 Lin ..... 403/325
5,779,235 A * 7/1998 Nakamura ..... 271/9.09
5,788,139 A * 8/1998 Sikora ..... 227/82
5,967,570 A * 10/1999 Lee ..... 292/31
6,027,194 A * 2/2000 Fleisch ..... 312/348.4
6,286,919 B1 * 9/2001 Fleisch ..... 312/348.4
6,362,868 B1 3/2002 Silverbrook
6,390,576 B1 * 5/2002 Walburn ..... 312/348.4
6,634,638 B1 * 10/2003 Toda et al. ..... 271/162
6,688,801 B1 * 2/2004 Husson ..... 403/322.1
6,935,711 B1 * 8/2005 Naue et al. ..... 312/334.4
6,957,878 B1 * 10/2005 Greenwald et al. ..... 312/334.4
6,981,752 B1 * 1/2006 Harn et al. ..... 312/348.4
2006/0023047 A1 * 2/2006 Green ..... 347/104

* cited by examiner

*Primary Examiner*—Patrick Mackey
*Assistant Examiner*—Jeremy R Severson

(57) ABSTRACT

A cartridge apparatus includes a media cassette, face plate and a locking and unlocking mechanism. The locking and unlocking mechanism includes a lock bar, a first post and a second post, and is configured to lock and unlock a cartridge during insertion in a printer.

33 Claims, 13 Drawing Sheets

LOCKING/UNLOCKING MECHANISM

BACKGROUND

A combination ink and media consumable cartridge, in the context of inkjet printers, would contain both an ink cartridge (also referred to as an "inkjet pen") and a media cartridge. In most printers the media cartridge and the inkjet pen are oriented such that the inkjet pen is either on top of, or in front of, the media cartridge. As the combination cartridge is integrally inserted into a print device (e.g., printer, photocopier, etc.), the overall size of the combination cartridge is dependent not only on the size of the inkjet pen and the media cartridge but is also dependent on the orientation of the inkjet pen with respect to the media cartridge.

As a result of the foregoing structural issues, the size of the combination cartridge has been, in large part, determined by the inkjet pen being positioned on top of, or in front of, the media cartridge. As a result, the shape of such a combination cartridge is irregular, thereby yielding high manufacturing costs. In addition, the package in which the irregularly shaped combination cartridge is shipped must be either correspondingly irregularly shaped (thereby avoiding empty space in the package) or be regularly shaped (thereby creating undesirable empty space in the package). However, if an irregularly shaped package is chosen, the packages can not be bundled on a shipping pallet without creating a similar amount of undesirable empty space between the packages. A direct result of the empty space (either in a regularly shaped package or between irregularly shaped packages) is higher shipping costs.

Accordingly, what is needed is a combination cartridge which addresses one or more of the aforementioned deficiencies in the prior art.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

DETAILED DESCRIPTION

Figure 1:
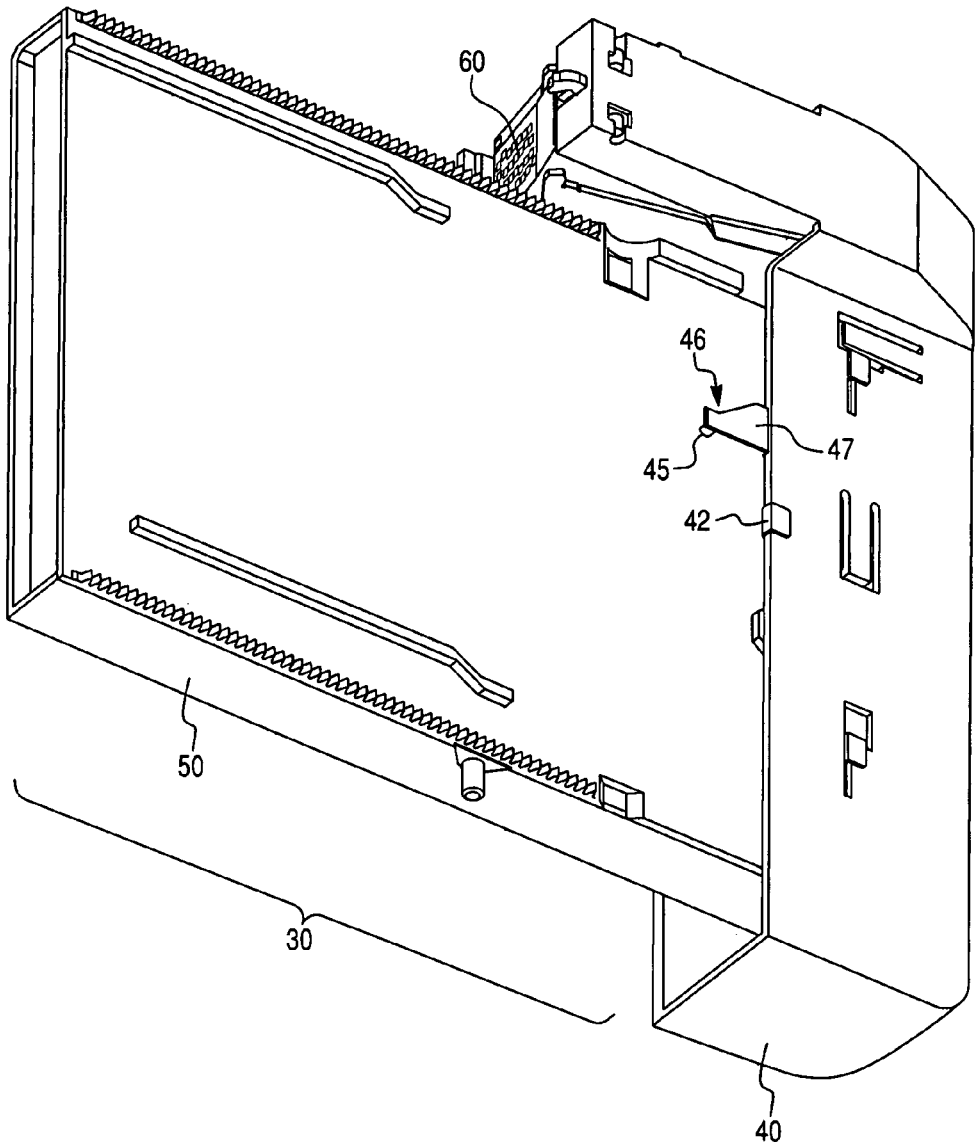
FIG. 1 is a perspective view of a cartridge according to one embodiment of the invention wherein the housing maintains the media cassette.

Reference will now be made in detail to various embodiments of the invention, which are illustrated in the drawings. An effort has been made to use the same reference numbers throughout the drawings to refer to the same or like parts.

An embodiment of a combined cartridge 30 configured to be installed in a printer 70 (FIG. 5) is disclosed in FIG. 1. The cartridge 30 includes a housing, such as a face plate 40, and a media cassette 50. The housing 40, in turn, includes a locking mechanism such as, for example, a lock bar 42.

Figure 2:
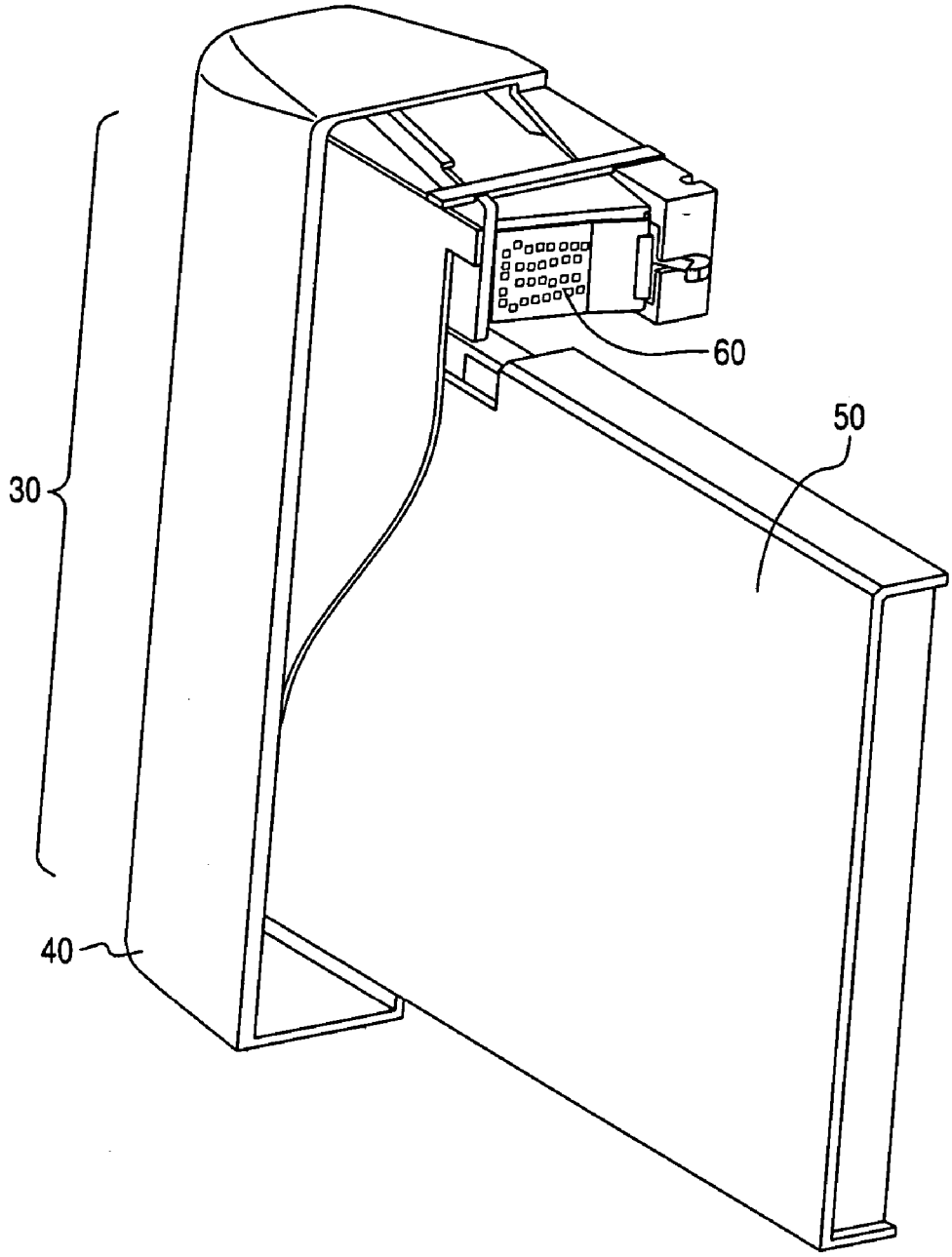
FIG. 2 is an underside view of the cartridge of FIG. 1.

As can be seen in FIG. 2, the face plate 40 is configured to hold the media cassette 50 when the cartridge 30 is outside of, or external of the printer 70. When the cartridge 30 is installed in the printer 70, however, the media cassette 50 is configured to separate from the face plate 40. The lock bar 42 (the details of which will later be described in detail) connects the media cassette 50 to the face plate 40 and disconnects media cassette 50 from the face plate 40 upon installation in the printer 70.

The printer 70 includes a printer mechanism chassis 72 (shown in FIGS. 5 and 6) which engages the cartridge 30. When the cartridge 30 is inserted into the printer 70, the housing 40 attaches to the chassis 72 by the lock bar 42. The media cassette 50 is configured to detach from the housing 40 after the housing 40 is attached to the printer chassis 72. After detachment, the media cassette 50 is carried by gears 76 in the printer 70 which transport the media cassette 50 into a media cassette working position.

When the cartridge 30 is to be removed from the printer 70, the media cassette 50 is transported by the printer gears 76 in a reverse manner to reattach to the housing 40. After the media cassette 50 reattaches to the housing 40, the housing 40 is ejected from the printer chassis 72, allowing for removal of the cartridge 30 from the printer 70. The return of the media cassette 50 may be activated by a command from a connected computer (not shown), a button, or any other suitable method.

Figure 15:
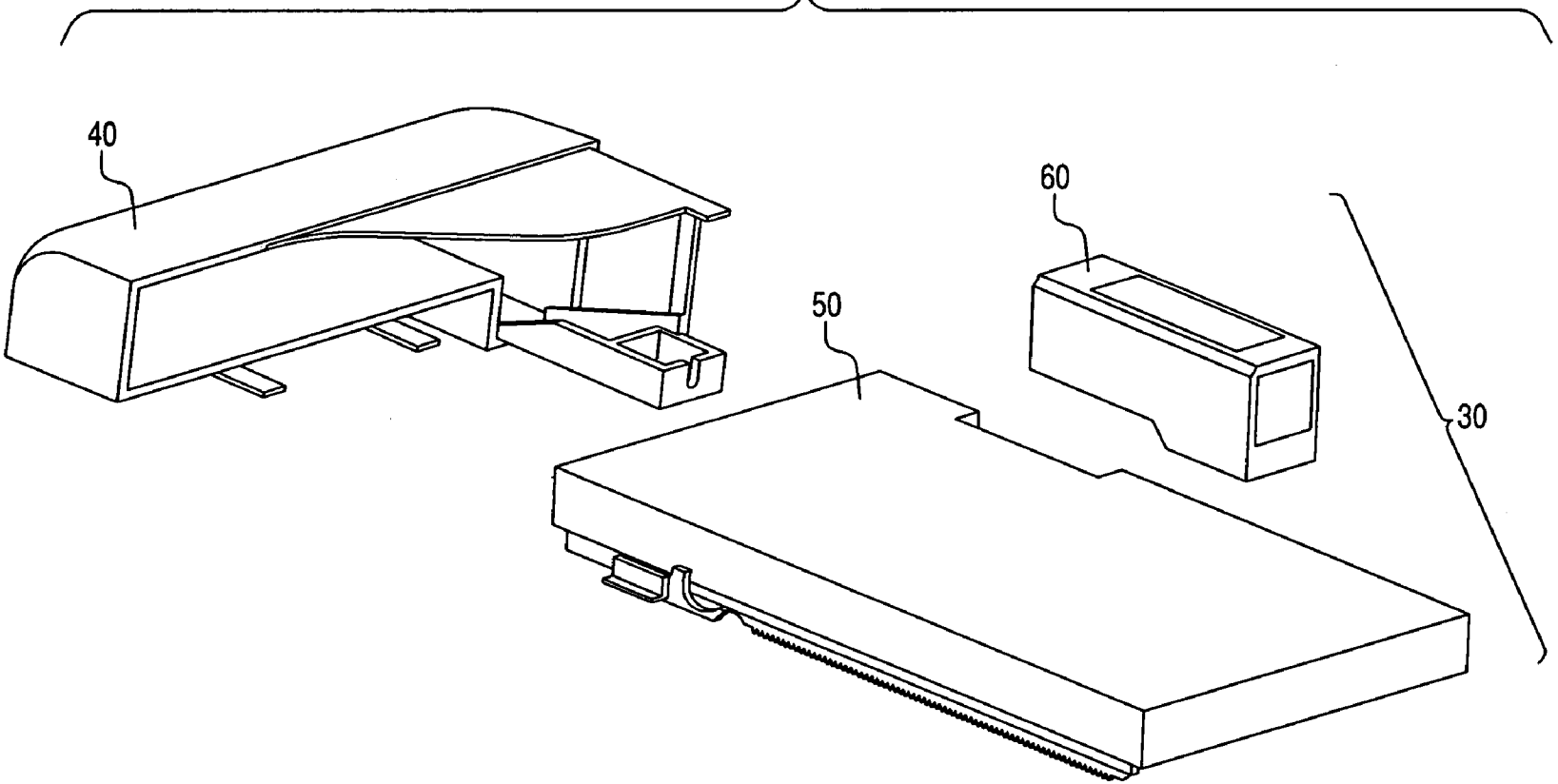
FIG. 15 is an exploded view of the cartridge of FIG. 3.

According to another embodiment of the invention shown in FIGS. 1, 2 and 15, the combination cartridge 30 may include an inkjet pen 60, a media cartridge 50, and a housing 40. The cartridge 30 may be configured to be installed in a printer 70. However, when the cartridge 30 is external, or separate from the printer 70, the housing 40 may be adapted to hold the inkjet pen 60 adjacent to the media cartridge 50. The inkjet pen 60 and media cassette 50 may be positioned in the housing 40 to be substantially parallel to each other. The inkjet pen 60 may be capped or uncapped when attached to and held by the housing 40. When the cartridge 30 is installed in the printer 70, the inkjet pen 60 and the cassette media cartridge 50 may be configured to separate. The pen 60 may be moved into a pen 60 working position and, before, after, or simultaneously with the positioning of the pen 60, the media cassette 50 may be positioned into a media cassette working position.

The cartridge 30 may be configured so the media cassette 50 and the pen 60 return to their original positions in the housing 40 when the cartridge 30 is to be removed from the printer 70. The cartridge 30 may be configured to be removed from the printer 70 with the inkjet pen 60 and the media cassette 50 in the housing 40.

Figure 5:
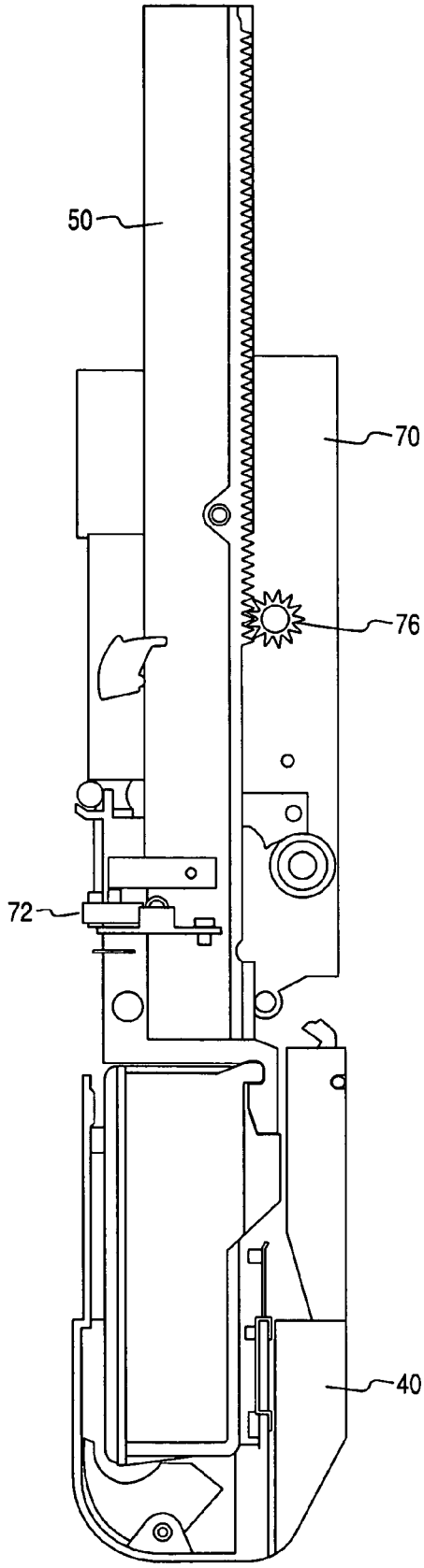
FIG. 5 is a cross-sectional view of the cartridge of FIG. 1 wherein the media cassette is initially engaged with the printer.
Figure 6:
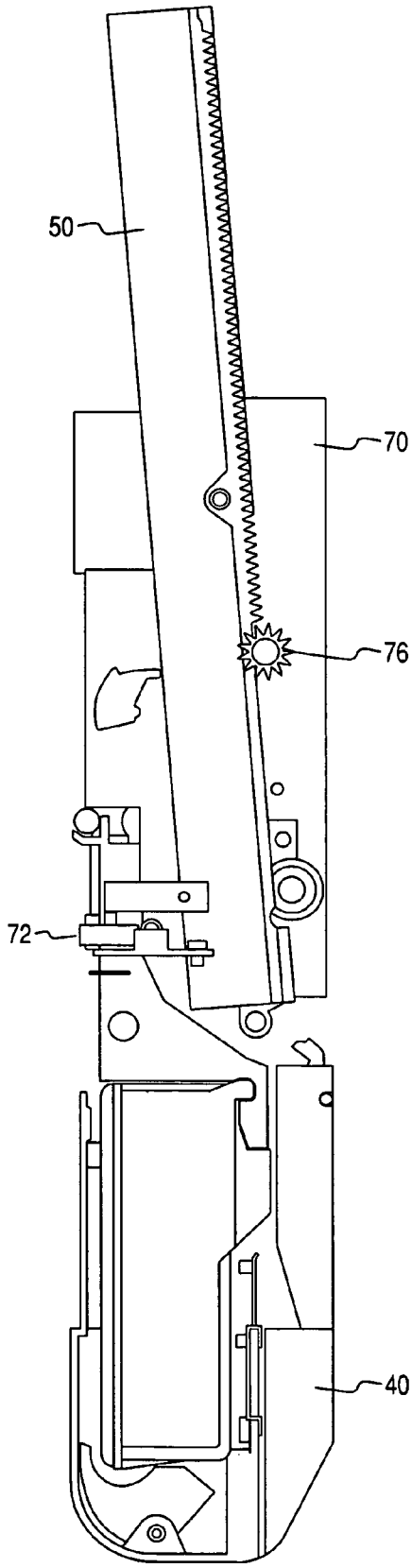
FIG. 6 is a cross-sectional view of the cartridge and printer of FIG. 5 wherein the media cassette is in a media cassette working position.

According to another embodiment of the invention shown in FIGS. 5 and 6, a printer 70 may include a cartridge 30 and a printer engagement mechanism 72. The cartridge 30 may include a pen 60, a media cassette 50 and a housing 40, as discussed in previous embodiments. The engagement mechanism may be a chassis 72. When the cartridge 30 is engaged with the printer engagement mechanism 72, the pen 60 and the media cassette 50 may be configured to separate into a pen working position and a media cassette working position, respectively. The pen 60 may be moved by a carrier mechanism, such as a first carrier (a locking/unlocking mechanism 62) and the media cassette 50 may be moved by a carrier mechanism, such as a second carrier (gears 76), or any other suitable mechanism to carry and/or position the pen 60 and cassette 50 into their respective working positions.

When the combination cartridge 30 is to be removed from the printer 70, the media cassette 50 and the pen 60 may be configured to return to their original positions in the housing 40. The cartridge 30 may then unlock or disengage from the printer 70 and be removed from the printer 70.

According to another embodiment of the invention, a method of using a combination cartridge 30 includes inserting the combination cartridge 30 into a printer 70. The combination cartridge 30 may include an inkjet pen 60; a media cartridge 50; and a housing 40 configured to hold the inkjet pen 60 adjacent the media cartridge 50, as discussed in previous embodiments. The inkjet pen 60 may be separated from the media cartridge 50 and/or from the housing 40 and the inkjet pen 60 may be moved into an inkjet pen working position. Before, after, or simultaneous with the position of the pen 60, the media cartridge 50 may be moved into a media cartridge working position.

The method may also include returning the media cartridge 50 to its original position in the housing 40 and returning the inkjet pen 60 to its original position in the housing 40, to recreate the combination cartridge 30. The combination cartridge 30 may then be removed from the print device 70.

The method may further include separating the inkjet pen 60 from the media cartridge 50 and/or from the housing 40, and disengaging a locking mechanism 62 which connects the inkjet pen 60 to the media cartridge 50 and/or the housing 40.

The method may include engaging the locking mechanism 42 before removing the combination cartridge 30 from the print device 70.

Figure 7:
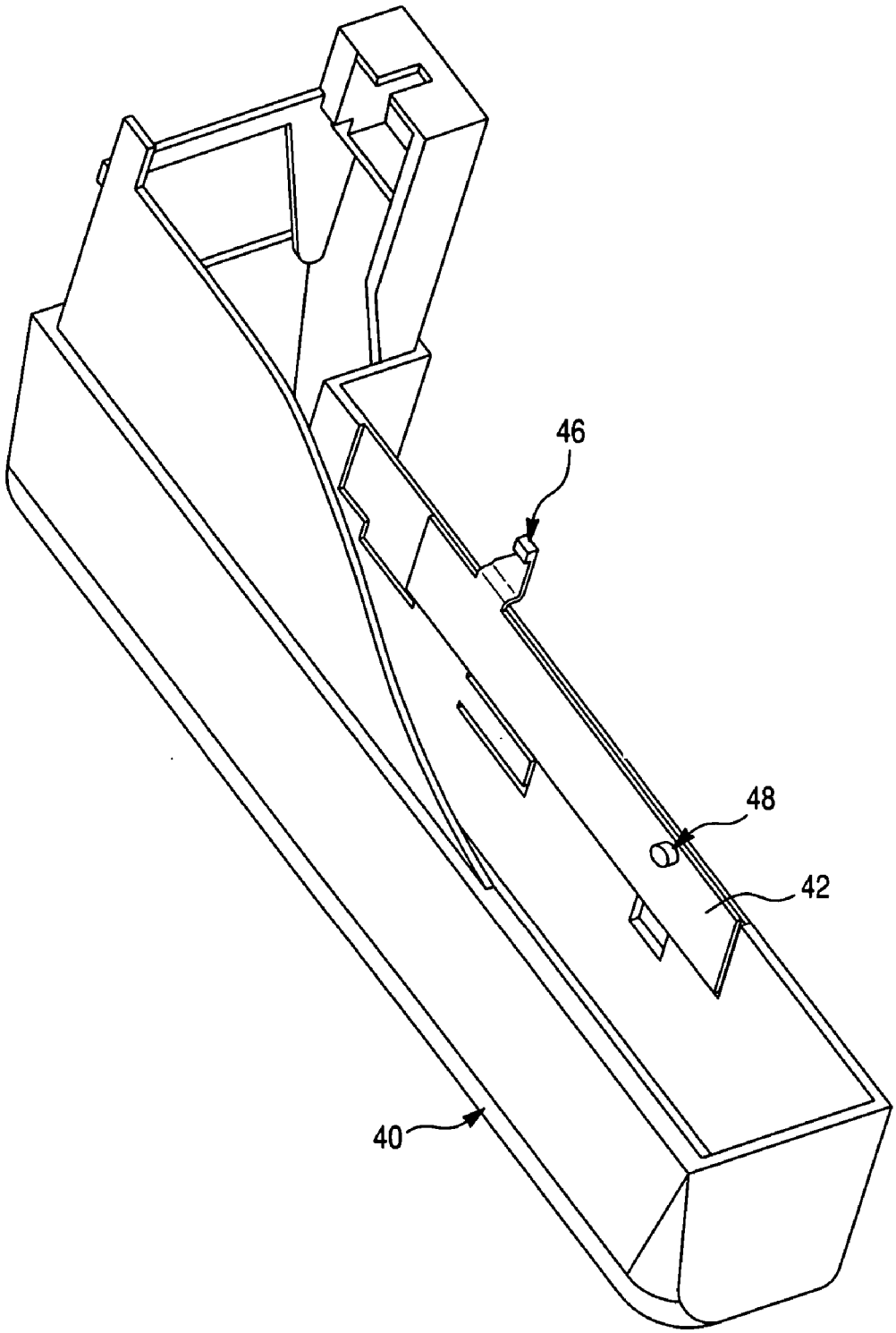
FIG. 7 is a perspective view of the housing according to an embodiment of the invention wherein the housing includes a lock bar and first and second posts.
Figure 8:
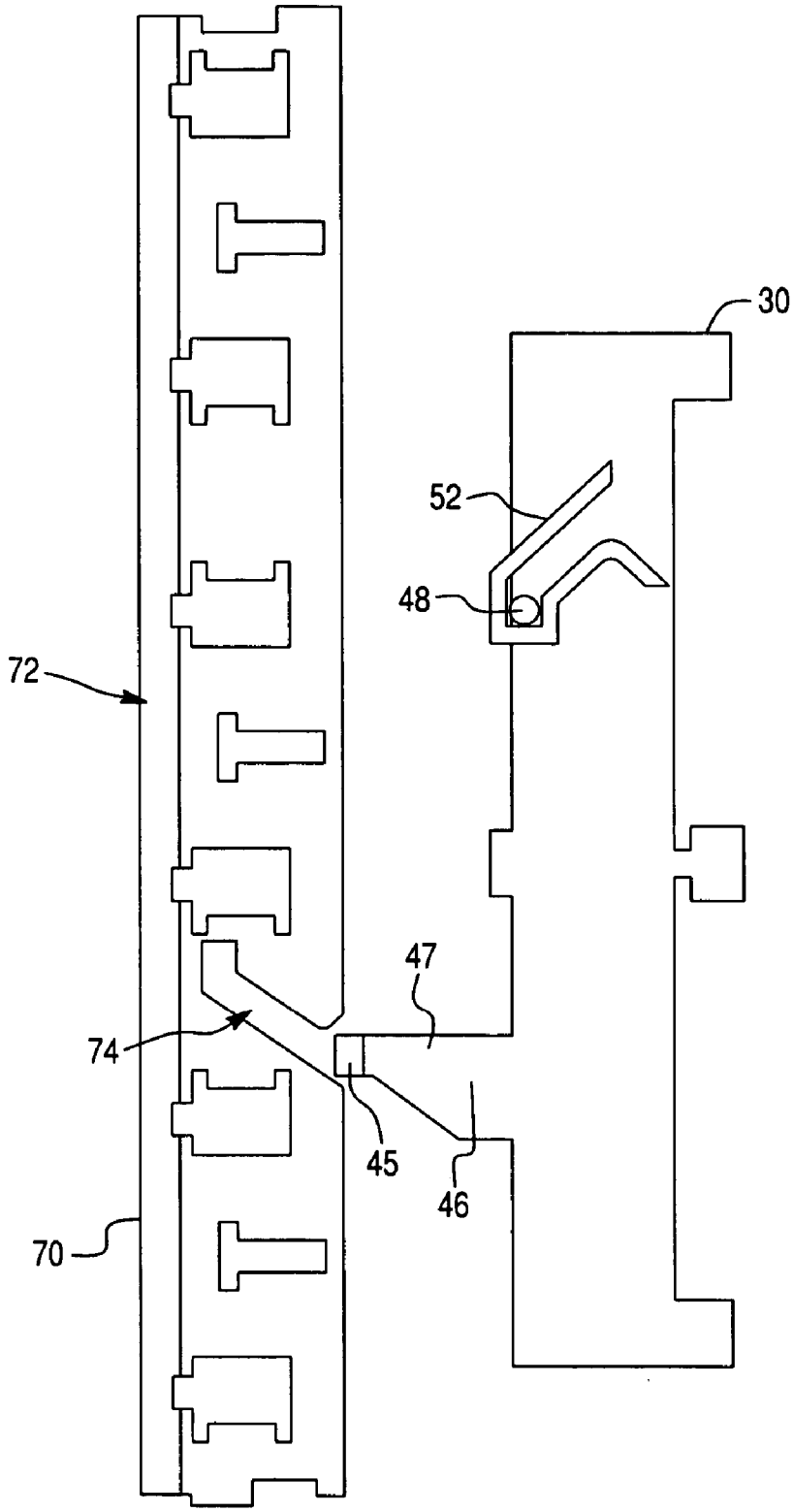
FIG. 8 is a cross-sectional view of the cartridge of FIG. 7, wherein the cartridge is aligned with a printer mechanism chassis.
Figure 9:
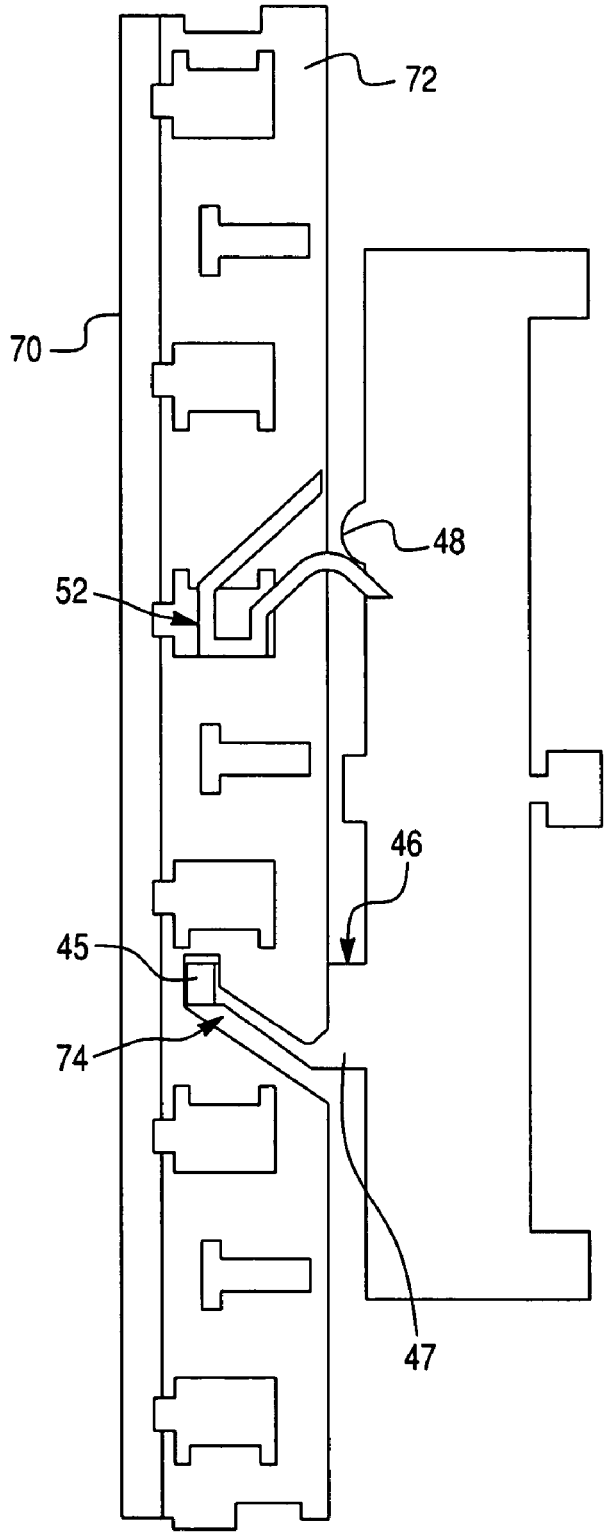
FIG. 9 is a cross-sectional view of the cartridge of FIG. 7, wherein the cartridge is engaged with the printer mechanism chassis.
Figure 10:
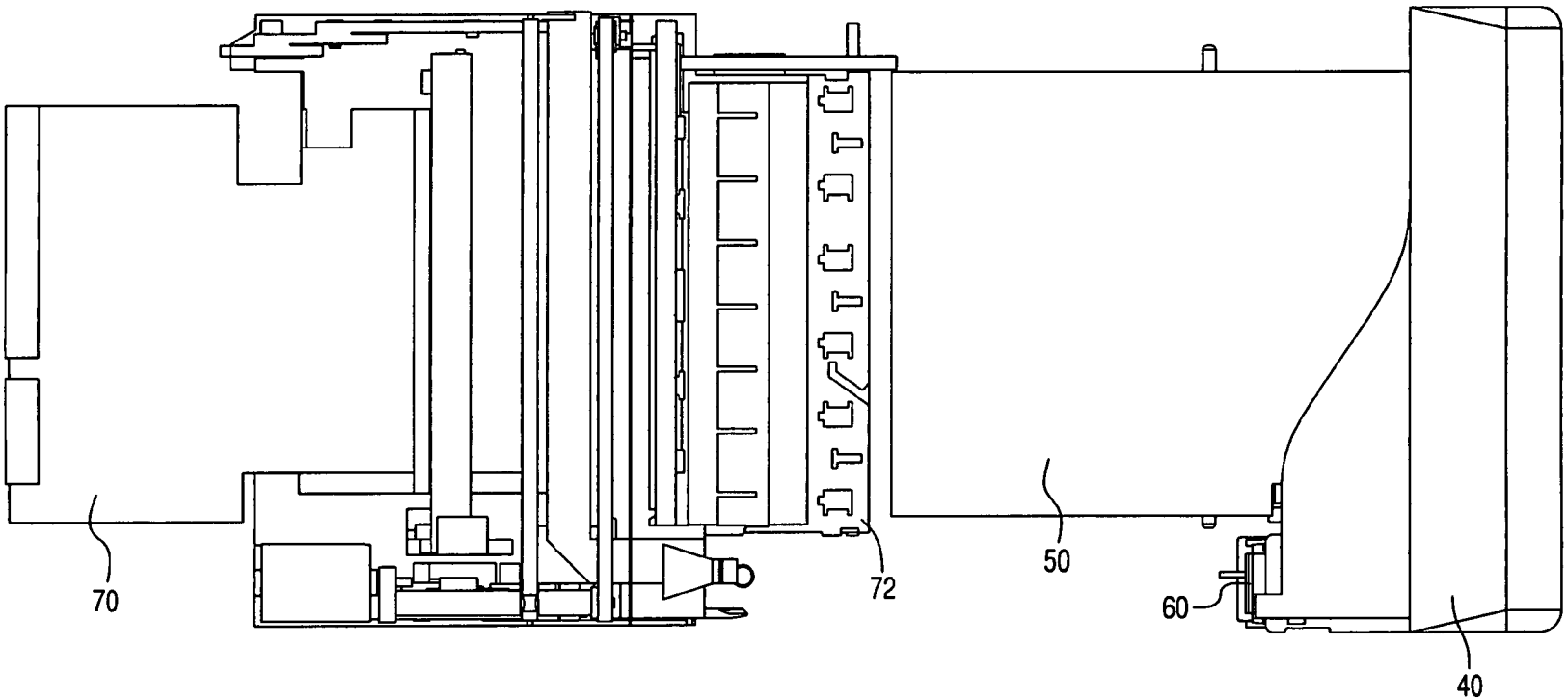
FIG. 10 is an overhead view of a printer according to an embodiment of the invention wherein a cartridge is disengaged from the printer.
Figure 12:
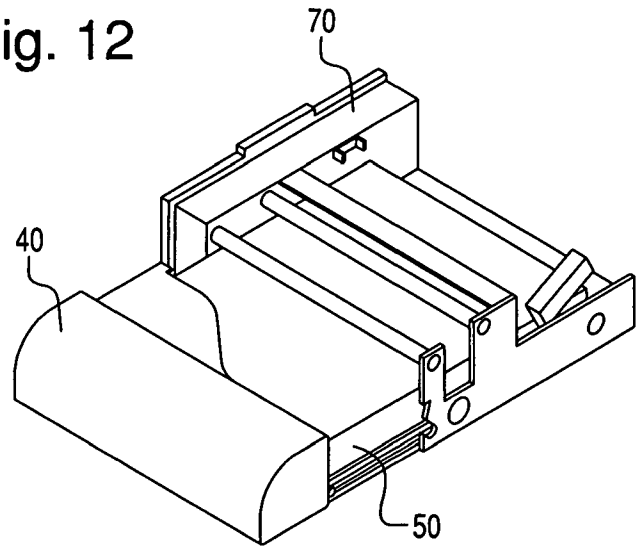
FIG. 12 is a break-away perspective view of the printer of FIG. 10 wherein the cartridge is attached to the printer and an ink pen moves to a ink pen working position.
Figure 11:
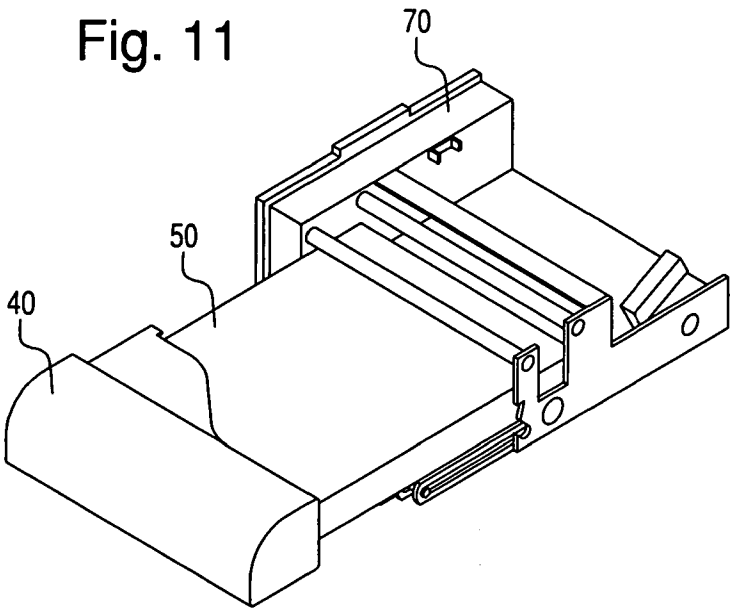
FIG. 11 is a break-away perspective view of the printer of FIG. 10 wherein the cartridge initially attaches to the printer.
Figure 13:
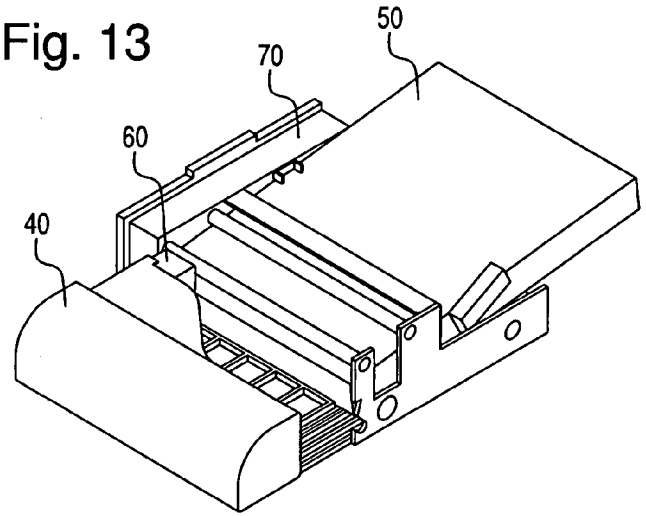
FIG. 13 is a break-away perspective view of the printer of FIG. 10, wherein the media cassette is in a media cassette working position.
Figure 14:
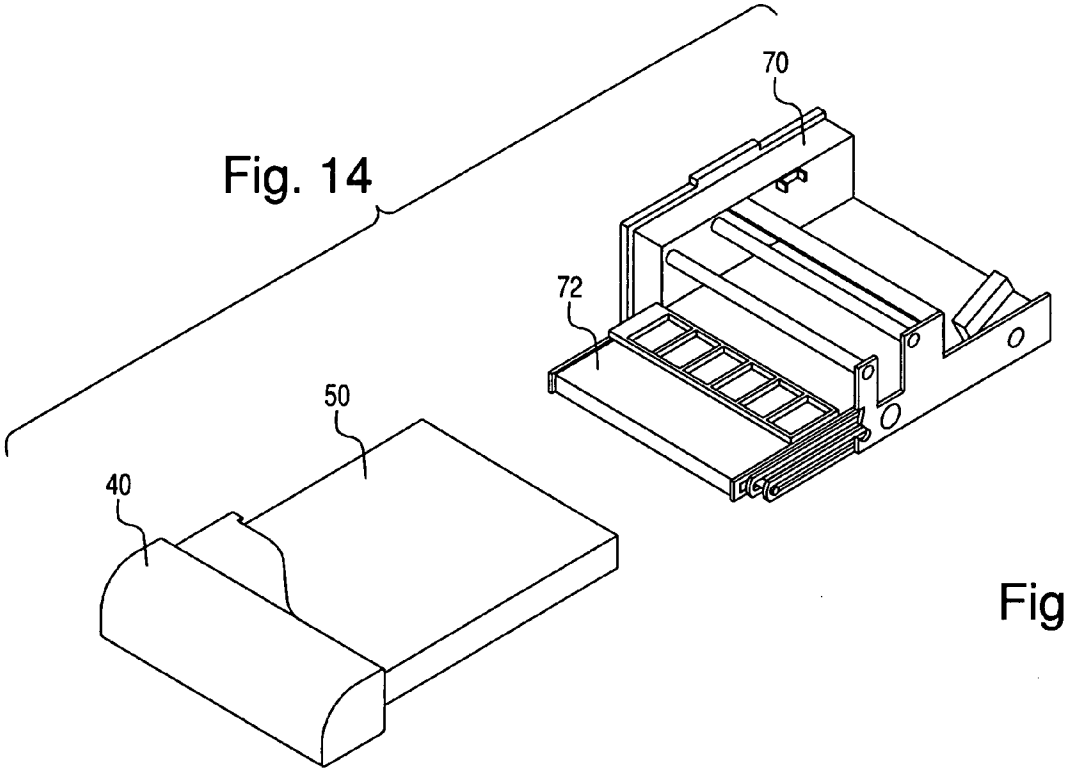
FIG. 14 is a break-away perspective view of the printer of FIG. 10, wherein the cartridge and printer are disengaged.

Another embodiment of the invention addresses a locking mechanism 42, as shown in FIGS. 7, 8 and 9. As previously mentioned, the housing 40 comprises a lock bar 42. The lock bar 42 may include a mechanism to connect or engage with the printer mechanism chassis 72 and/or a guiding mechanism 52 formed on the media cartridge 50, as shown in FIGS. 7–9. The lock bar 42, may be a releasable connection and may slide along the face plate 40 in a direction perpendicular to the direction in which the cartridge 30 may be installed in the printer 70. The locking mechanism 72 may include a chassis engaging mechanism, such as a first post 46, or any other suitable device. The first post 46 may extend from the lock bar 42 and may be configured to protrude from the lock bar 42 so that the first post 46 may interact with the printer chassis 72.

The first post 46 may be substantially "L" shaped having both a vertical portion 47 projecting from the lock bar 42 and a horizontal portion 45 projecting from the vertical portion 47 in a direction parallel to the media cassette 50.

In addition, the locking mechanism 42 may include a media cassette interacting device, such as a second post 48, or any other suitable device. The second post 48 may, like the first post 46, protrude from the lock bar 42 and may be configured to interact and engage with guiding ribs 52 on the media cassette 50.

Prior to insertion of the cartridge 30 into the printer 70, the second post 48 engages with the guide ribs 52 to lock the face plate 40 and media cassette 50 together. As shown in FIGS. 8 and 9, upon insertion of the cartridge 30 into the printer 70, the horizontal portion 45 of the first post 46 may engage with a first, angled, chassis slot 74, and subsequently moves along the length and contours of the first slot 74. As the lower portion 45 of the post 45 rides down the angled slot 74, the post 46 (and the lock bar 42 attached thereto) is forced laterally, i.e. in a direction perpendicular to the direction in which the media cassette 50 moves. When the lower portion 45 of the first post 46 reaches the end of the first slot 74, the housing 40 is locked to the chassis 72. In turn, the motion of the lock bar forces the second post 48 to move along the contours of the guide ribs 52, thereby disengaging the second post 48 from the guide ribs 52. When the guide ribs 52 are disengaged from the second post 48, the media cassette 50 is unlocked and detached from the housing 40. Once unlocked and detached, the media cassette 50 may be moved into a media cassette working position by gears 76 of the printer 70.

When the cartridge 30 is removed from the printer 70, the motion of the guide ribs 52 connects the second post 48 to the guide ribs 52 and disconnects or unlocks the first post 46 from the chassis 72. This allows for the media cassette 50 to return to the proper position in the housing 40 and for the housing 40 to unlock and, thus, separate from the printer 70.

Figure 3:
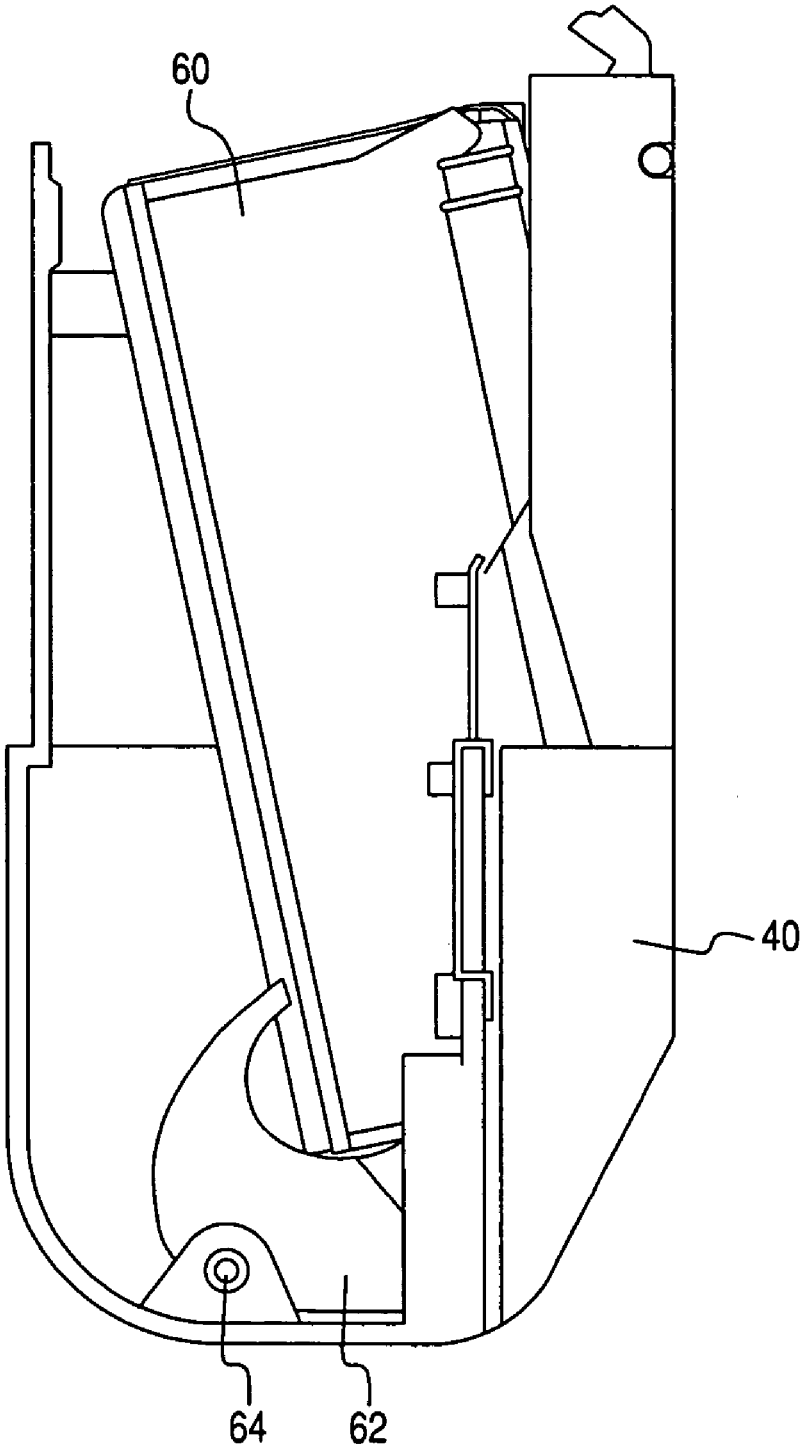
FIG. 3 is a perspective view of a cartridge according to another embodiment of the invention wherein the ink pen is engaged with the housing.
Figure 4:
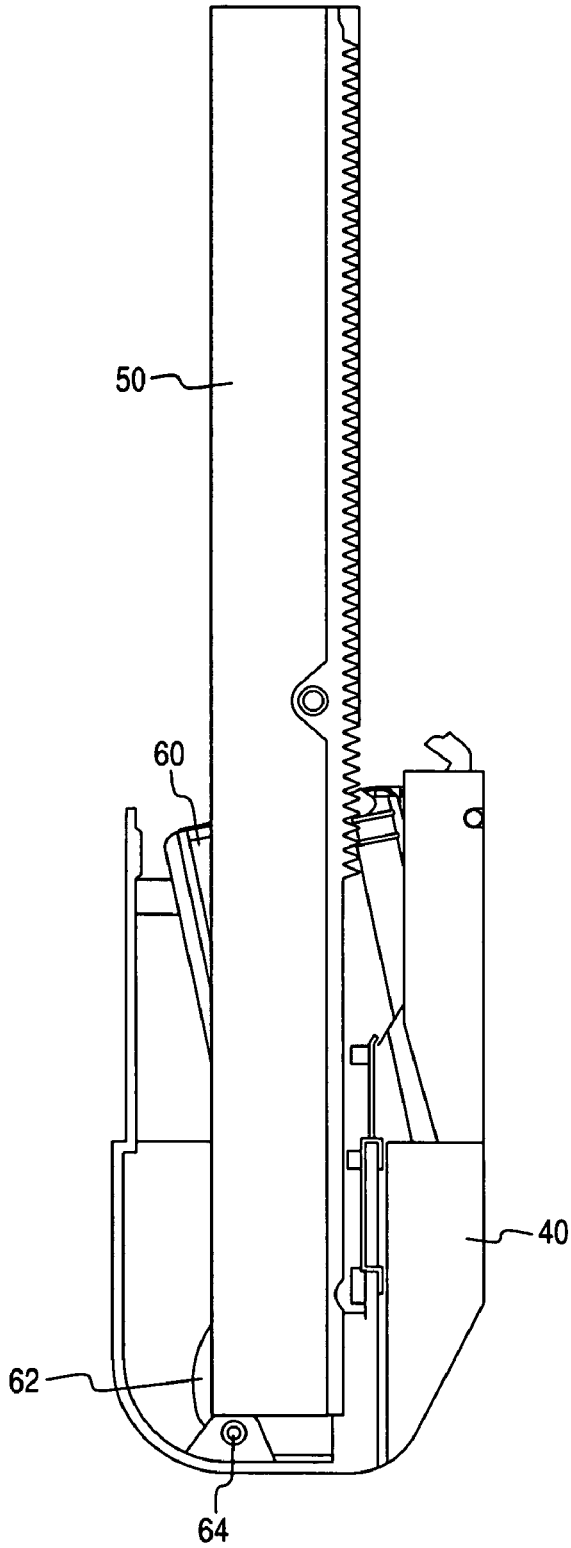
FIG. 4 is a cross-sectional view of the cartridge of FIG. 3 wherein the media cassette is engaged with the housing.

In some embodiments, as shown in FIGS. 3 and 4, the inkjet pen 60 may be locked in the housing 40 by a locking mechanism 62. The locking mechanism 62 is configured to unlock the inkjet pen 60 from the housing 40 by rotating the inkjet pen 60 and forcing the pen 60 forward in a direction of the printer 70, when the cartridge 30 is installed in the printer 70. When unlocking the pen 60, the locking mechanism 62 rotates about a pivot point 64 in a counterclockwise direction, thereby pushing the pen 60 into the printer 70. The pen 60 separates from the housing 40 and is positioned in a pen working position within the printer 70. The pen locking mechanism 62 may be activated automatically upon insertion of the cartridge 30 into the housing 40, by a button, or by any other suitable mechanism.

After the pen 60 separates from the housing 40 and is positioned in a pen working position, the media cassette 50 then separates from the housing 40 and is positioned into a media cassette working position. Of course, as will be apparent to those of ordinary skill in the art, the order of separation and movement could be switched. Moreover, the separation and movement of the media cassette 50 and the inkjet pen 60 could be simultaneous.

Given the foregoing disclosure, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A locking mechanism comprising:

a face plate comprising a slidable lock bar, and a first body comprising guide ribs;

wherein the lock bar is configured to releasably connect the first body and the face plate;

wherein the face plate is configured to hold the first body when the first body is not engaged to a second body; and wherein when the first and second bodies are engaged, the lock bar slides such that the first body separates from the face plate.

2. The locking mechanism according to claim 1, wherein the lock bar comprises a first post and a second post.

3. The locking mechanism according to claim 2, wherein the first post is configured to interact with the second body and the second post is configured to interact with guide ribs on the first body.

4. The locking mechanism according to claim 2, wherein the first post engages with a first chassis slot when the locking mechanism is aligned with the second body.

5. The locking mechanism according to claim 2, wherein the second post engages the guide ribs to lock the face plate and first body together when the locking mechanism is external of the second body.

6. The locking mechanism according to claim 4, wherein at least a portion of the first post is configured to move along the length of the first slot to lock the face plate to the second body.

7. The locking mechanism according to claim 6, wherein the movement induced by the first post in the first slot disengages the first body from the second post, such that the first body is configured to be moved separate from the face plate.

8. The locking mechanism according to claim 4, further comprising:

a third body positioned adjacent to the first body.

9. The locking mechanism according to claim 8, wherein the third body is configured to separate from the face plate when the first and the second bodies are engaged.

10. The locking mechanism according to claim 9, further comprising:

a third body locking/unlocking mechanism configured to lock/unlock the third body and the face plate.

11. The locking mechanism according to claim 7, wherein the first body is configured to be moved into a first body working position such that the first body is capable of performing intended work.

12. A locking mechanism comprising:

a face plate comprising a slidable lock bar, and a first body comprising guide ribs;

wherein the lock bar is configured to releasably connect the first body and the face plate;

wherein the face plate is configured to hold the first body when the first body is not engaged to a second body;

wherein when the first and second bodies are engaged, the lock bar slides such that the first body separates from the face plate; and wherein when the face plate and first body are removed from the second body, the guide ribs are configured to unlock the face plate from the second body chassis and lock the first body to the face plate.

13. The locking mechanism according to claim 8, wherein the first body is a media cassette, the second body is a printer chassis, and the third body is an inkjet pen.

14. A cartridge comprising:

a locking mechanism comprising:

a face plate, and a slidable lock bar, a media cassette comprising guide ribs;

wherein the face plate is configured to hold the media cassette when the cartridge is external of a first body, and wherein the lock bar is configured to connect the media cassette to the face plate.

15. The cartridge according to claim 14, wherein the face plate and media cassette are configured to separate when the cartridge is installed in the first body.

16. The cartridge according to claim 14, wherein the lock bar comprises a first post and a second post.

17. The cartridge according to claim 14, wherein a slot in the first body is configured to lock the face plate to the first body by attachment of at least a portion of the first post to the slot.

18. The cartridge according to claim 14, wherein a first carrier of the first body is configured to move the media cassette into a media cassette working position such that the media cassette is capable of performing intended work, after the media cassette is unlocked from the face plate.

19. The cartridge according to claim 14, wherein when the cartridge is to be removed from the first body, the media cassette is configured to be returned to the original position in the face plate, wherein the guide ribs are configured to lock the cassette to the face plate, and wherein the guide ribs are configured to unlock the face plate from the first body.

20. A method comprising the steps of:

(a) inserting a cartridge into a first body, the cartridge comprising:

a media cassette, and a face plate configured to hold the media cassette, (b) separating the media cassette from the face plate;

(c) attaching the face plate to the first body; and (d) moving the media cassette into a media cassette working position.

21. The method according to claim 20, wherein before the step of (b), the method further comprises the steps of:

(a1) engaging a first post with a slot in the first body, (a2) forcing the first post to follow a groove of the first body; and (a3) disengaging a second post and ribs on the media cassette.

22. The method according to claim 20, further comprising the steps of:

(e) returning the media cassette to its original position in the face plate;

(f) removing the cartridge from the first body.

23. The method according to claim 20, further comprising the steps of:

(g) unlocking the face plate from the first body, and (h) locking the media cassette to the face plate.

24. A cartridge comprising:

a face plate comprising a locking means, and a media cassette comprising guiding means;

wherein the cartridge is adapted to be installed in a first body, wherein the locking means is configured to releasably connect the media cassette and face plate;

wherein the face plate includes means to hold the media cassette external of the first body; and wherein when the cartridge is engaged with a first body, the media cassette is configured to separate from the face plate.

25. The cartridge according to claim 24, wherein the locking means comprises a chassis interacting means and a media cassette interacting means.

26. The cartridge according to claim 25, wherein the chassis interacting means is configured to engage with a first chassis slot when the cartridge is aligned with the first body.

27. The cartridge according to claim 25, wherein the media cassette interacting means is configured to lock the face plate and the cassette together when the cartridge is aligned with or external of the first body.

28. The cartridge according to claim 26, wherein the chassis interacting means is configured to move along the length of the first slot to engage the face plate to the chassis.

29. The cartridge according to claim 28, wherein the movement induced by the chassis interacting means in the first slot disengages the media cassette from the media cassette interacting means, and wherein the media cassette is positioned into a media cassette working position, such that the media cassette is capable of performing intended work.

30. The cartridge according to claim 29, wherein the media cassette is configured to separate from the face plate when in the media cassette working position.

31. The cartridge according to claim 24, wherein when the cartridge is removed from a first body, the guiding means are configured to unlock the face plate from the first body and lock the media cassette to the face plate.

32. The method according to claim 20, wherein the first body is a printer.

33. A locking mechanism comprising:

a face plate comprising a slidable lock bar, and a first body comprising guide ribs;

wherein the lock bar is configured to releasably connect the first body and the face plate;

wherein the face plate is configured to hold the first body when the first body is not engaged to a printer; and wherein when the first body and printer are engaged, the lock bar slides such that the first body separates from the face plate.

* * * * *